US009525233B2

(12) United States Patent
Staeber et al.

(10) Patent No.: US 9,525,233 B2
(45) Date of Patent: Dec. 20, 2016

(54) CONNECTING MODULE, POWER SUPPLY MODULE AND CONNECTING SET FOR LIGHT STRIPS

(71) Applicant: OSRAM GMBH, Munich (DE)

(72) Inventors: Tobias Staeber, Regenstauf (DE); Steffen Strauss, Nittendorf (DE)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 14/401,154

(22) PCT Filed: May 16, 2013

(86) PCT No.: PCT/EP2013/060155

§ 371 (c)(1),
(2) Date: Nov. 14, 2014

(87) PCT Pub. No.: WO2013/171305

PCT Pub. Date: Nov. 21, 2013

(65) Prior Publication Data

US 2015/0104971 A1 Apr. 16, 2015

(30) Foreign Application Priority Data

May 16, 2012 (DE) ..... 10 2012 208 249

(51) Int. Cl.
*F21V 7/04* (2006.01)
*H01R 13/46* (2006.01)
(Continued)

(52) U.S. Cl.
CPC ..... *H01R 13/46* (2013.01); *F21S 4/22* (2016.01); *F21V 23/06* (2013.01); *F21Y 2101/02* (2013.01); *F21Y 2103/003* (2013.01)

(58) Field of Classification Search
CPC . H01R 13/6641; H01R 13/7175; H01R 25/14; F21V 23/06; F21S 4/005; F21Y 2101/02; F21Y 2103/003
(Continued)

(56) References Cited

U.S. PATENT DOCUMENTS 5,306,165 A * 4/1994 Nadeau ..... H01R 25/14 439/115
5,559,681 A 9/1996 Duarte
(Continued)

FOREIGN PATENT DOCUMENTS

CN 201672346 U 12/2010
CN 102428318 A 4/2012
(Continued)

OTHER PUBLICATIONS

International Search Report mailed on Aug. 2, 2013 in PCT/EP2013/060155.
(Continued)

*Primary Examiner* — Amy Cohen Johnson
*Assistant Examiner* — Milagros Jeancharles
(74) *Attorney, Agent, or Firm* — Viering, Jentschura & Partner mbB

(57) ABSTRACT

Various embodiments may relate to a connecting module for mechanically connecting two light strips each having at least one semiconductor light source and having at least two electrical contacts arranged in a housing, which electrical contacts each have two contact sections for making electrical contact with the light strips. The electrical contacts in each case pass through the housing with a further contact section for connection to a power supply.

7 Claims, 2 Drawing Sheets

(51) Int. Cl.
*F21V 23/06* (2006.01)
*F21Y 101/02* (2006.01)
*F21Y 103/00* (2016.01)

(58) Field of Classification Search
USPC ..... 439/527, 490, 676, 76.1, 218, 289; 362/181, 183, 184, 191, 224, 240, 362/249.01–249.11
See application file for complete search history.

(56) References Cited

U.S. PATENT DOCUMENTS 6,422,716 B2 7/2002 Henrici et al.
7,892,022 B2 * 2/2011 Mostoller ..... F21V 19/0055 439/507
8,240,894 B2 * 8/2012 Sanroma ..... A47F 3/001 362/398
8,251,723 B2 * 8/2012 Tsai ..... H01R 24/38 439/108
8,257,106 B2 * 9/2012 Fornage ..... H01R 13/639 439/304
8,262,250 B2 * 9/2012 Li ..... F21S 4/006 362/219
8,517,759 B1 * 8/2013 Brown ..... H01R 31/06 439/492
8,714,772 B1 * 5/2014 Levante ..... F21S 4/003 362/217.17
9,115,858 B2 * 8/2015 Levante ..... F21S 4/005
2001/0024368 A1 9/2001 Henrici et al.
2007/0242466 A1 10/2007 Wu et al.
2010/0277098 A1 11/2010 Sarna
2011/0045704 A1 * 2/2011 Li ..... H01R 4/2404 439/638
2012/0081889 A1 4/2012 Frost et al.
2012/0238129 A1 * 9/2012 Lo ..... H01R 12/616 439/426

FOREIGN PATENT DOCUMENTS

DE 10012734 C1 9/2001
DE 102009021846 A1 12/2010

OTHER PUBLICATIONS

Office Action issued for German patent application 102012208249.2 on Jan. 25, 2013.
Chinese Office Action based on Application No. 201380025735.3(7 Pages and 9 pages of English translation) dated Jan. 25, 2016 (Reference Purpose Only).

* cited by examiner

CONNECTING MODULE, POWER SUPPLY MODULE AND CONNECTING SET FOR LIGHT STRIPS

RELATED APPLICATIONS

The present application is a national stage entry according to 35 U.S.C. §371 of PCT application No.: PCT/EP2013/060155 filed on May 16, 2013, which claims priority from German application No.: 10 2012 208 249.2 filed on May 16, 2012, and is incorporated herein by reference in its entirety.

TECHNICAL FIELD

Various embodiments relate to a connecting module, to a power supply module for supplying power to at least one light strip, and to a connecting set for mechanically connecting and supplying power to light strips.

BACKGROUND

An LED strip which consists of one or more flexible LED modules is known from the LINEARLight Flex series by Osram GmbH. Each LED module has a strip-shaped flexible printed circuit board ("flexible strip" or "flexible board"), which is populated with light-emitting diodes ("LEDs") on the front side. The LED module can be constructed contiguously from uniform basic elements, between which the LED module is separable in order to thus form correspondingly shorter LED modules. The LED modules are mechanically and electrically connectable to one another and to a power supply via proprietary connectors, for example from the CONNECTSystem series by Osram GmbH. The power supply is configured as a separate, enclosed power supply unit, for example from the OPTOTRONIC series by Osram GmbH. A length of an individual, contiguous LED strip is limited owing to a drop in a supply voltage as the distance from a feed point increases.

DE 10 2009 021 846 A1 discloses a light strip to which current is supplied at one end by a power supply module. Alternatively, the power supply module can be arranged between two light strips as intermediate feeder. In order to avoid irregularities in a light pattern of the light strip, in particular in a light source pitch, the power supply module has a plurality of LEDs.

One disadvantage with this solution consists in that the power supply module has a complex configuration in terms of apparatus.

SUMMARY

Various embodiments provide a connecting module for light strips which has a simple design in terms of apparatus and can be used flexibly and in a versatile manner. Furthermore, various embodiments provide a power supply module with a simple design in terms of apparatus and which can be used flexibly. In addition, various embodiments provide a connecting set including a connecting module and a power supply module which has a simple design in terms of apparatus and can be used flexibly.

In accordance with the disclosure, a connecting module for mechanically and electrically connecting two light strips each having at least one semiconductor light source, in particular one light-emitting diode, is provided. The light strips are in particular strip-shaped flexible printed circuit boards. The connecting module preferably has at least two electrical contacts, which are arranged in a housing and which each have two contact sections for making electrical contact with the light strips, in particular end regions. In addition, a respective contact has a contact section which passes through the housing towards the outside in order to connect a power supply thereto.

This solution has the advantage that the connecting module can firstly be used to electrically and mechanically connect light strips and is additionally usable for the electrical connection of the light strips. A current can therefore be fed between two light strips in a simple manner by means of the connecting module which has an extremely simple configuration in terms of apparatus. Such a central feed has the advantage that a possible length of the light strips is increased since a voltage drop occurs in two directions. Owing to the configuration of the connecting module which is extremely simple in terms of apparatus, it is furthermore possible to configure said connecting module in a manner which saves on installation space and is compact with little complexity, as a result of which a pitch of the light-emitting diodes between two light strips connected to the connecting module is advantageously not increased in size.

Preferably, the contact sections of the contacts which are provided for the power supply pass through the housing from a common connection side, wherein this common connection side points approximately in an emission direction of an adjacent semiconductor light source. The connection side is therefore an easily accessible upper side.

In various embodiments, the housing has two connecting sides which point away from one another, in particular extend approximately parallel to one another. A respective connecting side is used for mechanically connecting a respective light strip. The connection side is then advantageously formed between the connecting sides and in particular extends perpendicular thereto. It is conceivable to provide further connecting sides in addition to the two connecting sides in order to connect, for example, further light strips mechanically and electrically to one another via the connecting module.

Esthetically, the housing can be configured in the form of a right-parallelepiped, for example, in order to match said housing to the external shape of the light strips.

Preferably, a respective contact section of the contacts which is used for power supply opens out approximately centrally into the connection side, when viewed in the longitudinal direction of the connecting element, i.e. approximately in the direction of the light strips. In the transverse direction, the contact sections can then simply be spaced apart from one another. This has the advantage that the connecting module can be configured to be symmetrical owing to the central arrangement of the contact sections and can therefore be inserted between two light strips with any desired orientation.

The contacts of the connecting module are in particular arranged transversely to the longitudinal direction with a parallel spacing with respect to one another.

In accordance with various embodiments, a power supply module for supplying power to at least one light strip is provided. This is advantageously configured in such a way that it is connectable electrically and in particular also mechanically to a connecting module according to the disclosure. In contrast to the related art explained at the outset, the power supply module serves merely to supply power to the light strips and not for the mechanical connection thereof. The power supply module can therefore be configured independently from the connecting module, apart from the interface with the connecting module. Furthermore, it is advantageous if a plurality of light strips with a plurality of connecting modules are used and the power supply module can be positioned flexibly on any desired connecting module. By attaching the power supply module, there is no interference in the length extent of the composite structure including the connecting module and the light strips.

It is conceivable that the power supply module therefore also can be added to by a plurality or multiplicity of light strips in a simple manner once one or more connecting modules have been fitted or is added to on additional fitting of further connecting modules and light strips.

The power supply module may have a connection side, in which contacts for making contact with contacts of the connecting module open out. Preferably, a number of contacts of the power supply module corresponds to the number of contacts of the connecting module. Contact can be made between the contacts of the connecting module and the power supply module in a force-fitting, cohesive and/or form-fitting manner. Conceivable, by way of example, is a plug-type connection or a force-fitting connection with contact areas of the contacts bearing against one another.

The power supply module is preferably configured in such a way that it is esthetically mechanically connectable, flush, to the connecting module. The connecting module may in this case be configured in the form of a right-parallelepiped, for example. The power supply module may be connected to the connecting module likewise in a force-fitting, cohesive and/or form-fitting manner. Advantageously, the connection is a detachable connection, in particular a snap-action connection or a magnetic connection.

In various embodiments, the power supply module has an outer side which points away from the connection side and which can extend approximately parallel thereto, and peripheral sides formed between the connection side and the outer side. At least one supply line for connecting the contacts of the power supply module to a current source in this case advantageously opens out in one of the peripheral sides. Owing to the fact that the supply line or a cable leadout is passed out laterally, said supply line or cable leadout pass substantially away from an emission direction of the light-emitting diodes of the light strips. Furthermore, the power supply module thus has a comparatively low height. If the power supply module is arranged, for example, together with the connecting module and the light strips on a common surface, a design in which the supply lines are passed out laterally is comparatively space-saving in terms of installation space.

For making contact between the contacts of the power supply module and the contacts of the connecting module in a simple manner, the contacts of the power supply module can each have a contact area with at least two area sections. By means of the plurality of area sections of a respective contact area, contact can be made between the power supply module, in a plurality of orientations, and the connecting module. Preferably, the area sections are arranged in such a way that the power supply module is connectable, in at least four different orientations, electrically to the connecting module.

Area sections of a respective contact can be arranged simply on a partial circle, wherein an area section of a respective contact, in a state in which the power supply module is connected to the connecting module, is arranged approximately on a transverse axis which extends transversely to the longitudinal direction, and a further area section is arranged on a longitudinal axis extending approximately in the longitudinal direction. It would also be conceivable for the contact areas to be configured in sickle-shaped or ring-shaped fashion.

Preferably, two contacts of the power supply module are provided whose area sections are each arranged on a common or on different partial circles. If three contacts are provided, the area sections of two contacts can be arranged on a common partial circle, for example. In the case of four contacts, it is conceivable for the area sections of in each case two contacts to be arranged on a common partial circle.

In accordance with various embodiments, a connecting set for mechanically connecting and supplying power to light strips is provided. Said connecting set has at least one power supply module according to the present disclosure and one connecting module according to the present disclosure. Such a connecting set is usable extremely easily for mechanically connecting and making electrical contact with light strips. If a plurality of connecting modules are provided, a power supply module can be connected to a respective connecting module, flexibly and depending on the desired use. For example, it is conceivable for a plurality of light strips to subsequently be extended in a simple manner. If, for example, two light strips with one connecting set according to the present disclosure are laid, and, for example, two further light strips with at least one connecting module according to the present disclosure are connected to the existing light strips, the power supply module can be converted to the new connecting module.

The contacts in the connection side of the power supply module and/or the contacts in the connection side of the connecting module of the connecting set are preferably configured in such a way that the power supply module is electrically connectable, in a plurality of orientations, to the connecting module.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

Figure 1:
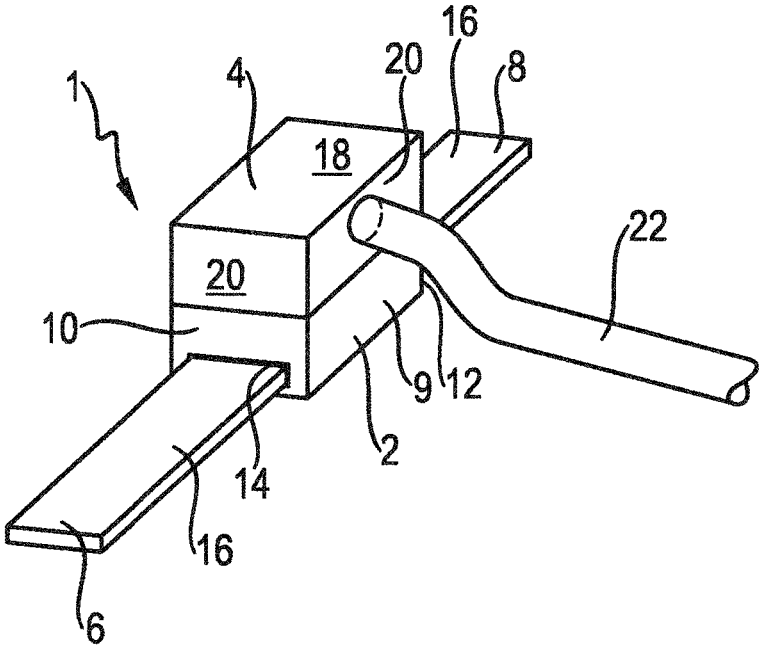
FIG. 1 shows a perspective schematic illustration of a connecting set including a power supply module and a connecting module.

FIG. 1 shows a connecting set 1, which has a connecting module 2 and a power supply module 4. The connecting module 2 is used for connecting two light strips 6 and 8.

The substantially right-parallelepipedal connecting module 2 has a first connecting side 10 formed on a housing 9 and a second connecting side 12 pointing away therefrom and extending approximately parallel thereto. A respective connecting side 10 and 12 has a receiving opening 14 for receiving a respective light strip 6 or 8. A respective light strip 6 and 8 is in the form of an LED module and has a strip-shaped flexible mount, with light-emitting diodes (not illustrated) arranged on the upper side 16 of said mount. A rear side of the light strips 6 and 8 may have an adhesive tape in order to fasten said light strips flat on a heat sink (not illustrated), for example.

Current is supplied to the light strips 6 and 8 via the power supply module 4, which is likewise substantially right-parallelepipedal and is connected flush to the connecting module 2. The power supply module 4 has an outer side 18 or upper side which points away from the connecting module 2 and which is surrounded by four peripheral sides 20. A supply line 22 or a power supply cable extends from one peripheral side 20 extending in the longitudinal direction. The supply line 22 in this case opens out approximately centrally in this peripheral side 20. By virtue of the lateral arrangement of the supply line 22, the connecting set 1 has a configuration which is comparatively flat and space-saving in terms of installation space.

Figure 2:
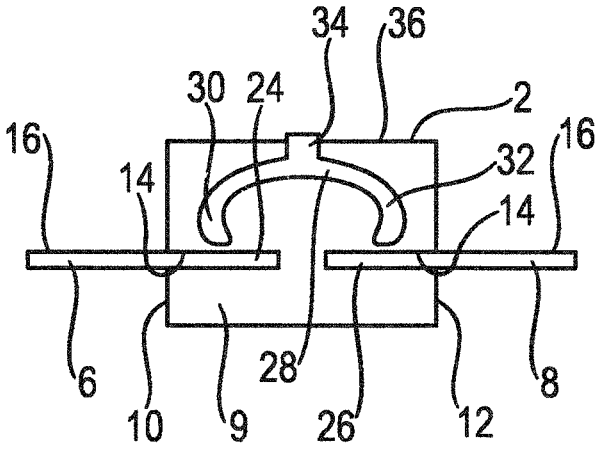
FIG. 2 shows a view of a longitudinal section through the connecting module having two light strips.

FIG. 2 shows the connecting module 2 in a longitudinal sectional view together with the light strips 6 and 8. The light strip 6 on the left in FIG. 2 is inserted into the left-hand receiving opening 14 in the left-hand connecting side 10 with an end section 24, and the right-hand light strip 8 is inserted into the receiving opening 14 in the right-hand connecting side 12 with an end section 26. The end sections 24 and 26 are arranged in the connecting module 2 approximately in the same plane and are spaced apart from one another. The light strips 6 and 8 are held in a conventional manner in the receiving openings 14 in the connecting module 2. The hold can in this case be a force-fitting, form-fitting and/or cohesive hold. The light strips 6 and 8 are therefore mechanically connected to one another via the connecting module 2. For the electrical connection of the light strips 6 and 8, a plurality of contacts 28 are arranged in the connecting module 2, of which contacts one is shown in FIG. 2. One or more further contacts are arranged in series with the contact 28, when viewed in the direction of a plane of the drawing in FIG. 2. Therefore, at least a plurality of contacts are arranged one behind the other in a direction transverse to the longitudinal direction of the connecting module 2. A respective contact 28 is arc-shaped and has a first and second contact section 30 and 32, respectively. A respective contact section 30 and 32 in this case bears on the upper side 16 of the light strips 6 and 8, respectively, for making electrical contact, wherein, as shown in FIG. 2, the contact sections 30 and 32 are spaced apart slightly from the light strips 6 and 8 for the purposes of improved illustration. The contact 28 is inserted into and held in the connecting module 2 in such a way that, when the light strips 6 and 8 are inserted into the connecting module 2, said contact is tensioned and the contact sections 30 and 32 are pressed onto the light strips 6 and 8, respectively, with a tensioning force, as a result of which said light strips can be held in the connecting module 2 and a secure electrical contact is produced. The same does of course apply to the one or more further contacts (not illustrated). The arc-shaped contact 28 therefore substantially spans the end sections 24 and 26 of the light strips 6 and 8, respectively. The contact 28, in the same way as all of the other contacts which are not illustrated, has a further contact section 34, which passes through an upper connection side 36 of the housing 9. The connection side 36 points away from the light strips 6 and 8 in the direction of the power supply module 4 from FIG. 1. The contact section 34 passes through the connection side 36, when viewed in the longitudinal direction, approximately centrally and extends likewise approximately centrally away from the arc-shaped contact 28 in the manner of a projection.

Figure 3:
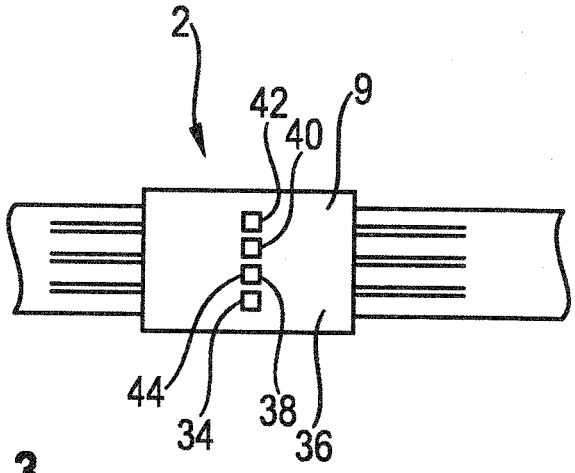
FIG. 3 shows a plan view of the connecting module including two light strips.

FIG. 3 shows, in a plan view of the housing 9 of the connecting module 2, four contact sections 34, 38, 40 and 42 which open out into the connection side 36. The contact sections 34, 38 to 42 each have an approximately rectangular contact area 44. The number of contacts 28 is dependent on the light-emitting diodes to be energized. If, for example, one or more white light-emitting diodes or white LEDs of the light strips 6, 8 are intended to be energized, it would be sufficient to only use two contacts.

Figure 4:
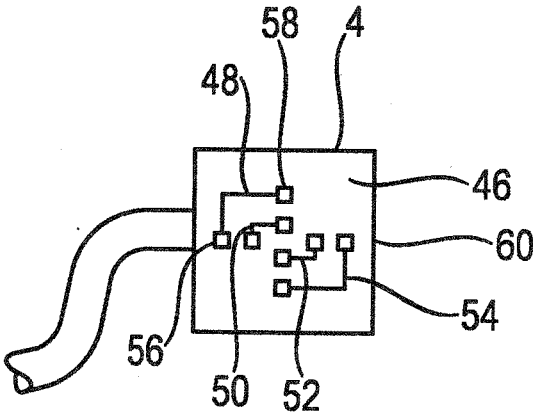
FIG. 4 shows a view from below of the power supply module.

For the electrical power supply to the contacts 28 shown in FIG. 2, the power supply module 4 is provided (see FIG. 4). Said power supply module likewise has a connection side 46, which, in the state in which the connecting module 2 and the power supply module 4 are connected, as shown in FIG. 1, points towards the connecting module 2 and is arranged opposite the connection side 36 of the connecting module 2 shown in FIG. 2. The power supply module 4 has a corresponding number of contacts 48, 50, 52 and 54 with respect to the connecting module 2 in order to be able to make electrical contact therewith. A respective contact 48 to 54 has in each case one contact area having two area sections 56 and 58, which are only provided with a reference symbol in the case of the contact 48, for reasons of improved clarity. The area sections 56 and 58 each open out in the connection side 46. The remaining contact can in this case be arranged in the housing 60 of the connecting module 2. The area sections 58 of the contacts 48 to are arranged one behind the other, when viewed in the longitudinal direction, and the area sections 56 are arranged one behind the other, when viewed in the transverse direction. Therefore, the area sections 58 extend approximately along a first line and the area sections 56 extend approximately perpendicular thereto along a second line, wherein the lines cross over symmetrically. A spacing between the area sections 58 and the area sections 56 within one line is in this case selected such that this spacing corresponds to the spacing of the contact sections 34, 38 to 42 of the connecting module 2 shown in FIG. 3 in order that, in the state in which the power supply module 4 and the connecting module 2 are connected, as shown in FIG. 1, the contacts 48 to 54 of the power supply module 4 can bear against the contacts 28 of the connecting module 2. The area sections 56 and 58 of the contacts 50 and 52 lie on a first common small partial circle, and the area sections 56 and 58 of the contacts 48 and 54 lie on a second large common partial circle. By virtue of this arrangement of the area sections 56 and 58 of the contacts 48 to 54, said contacts can be connected to the contact sections 34, 38 to 42 shown in FIG. 3 in four different orientations. The contacts 48 and 54 with their area sections 56 and 58 are therefore connectable flexibly to the connecting module 2 by virtue of their symmetrical arrangement. For this purpose, it is advantageous if the connection area 46 of the power supply module 4 is substantially in the form of a square. In contrast to the illustration shown in FIG. 3, it is advantageous if the connection side 36 of the connecting module 2 is also in the form of a square, as a result of which the connection side 36 and the connection side 46 can be opposite one another flush in the connected state.

A mechanical connection between the connecting module 2 and the power supply module 4 is produced via a conventional snap-action connection, for example, which can be formed to the side of the connecting module 2 and the power supply module 4.

Various embodiments disclose in particular a connecting set for mechanically and electrically connecting light strips and for supplying power to light strips. The connecting set has a connecting module, which has contact sections for connection to a current source and can connect at least two light strips mechanically. A power supply module with contacts can be connected to the contact sections.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

LIST OF REFERENCE SYMBOLS

1 Connecting set
2 Connecting module
4 Power supply module
6 Light strip
8 Light strip
9 Housing
10 Connecting side
12 Connecting side
14 Receiving opening
16 Upper side
18 Outer side
20 Peripheral side
22 Supply line
24 End section
26 End section
28 Contact
30 Contact section
32 Contact section
34 Contact section
36 Connection side
38 Contact section
40 Contact section
42 Contact section
44 Contact area
46 Connection side
48 Contact
50 Contact
52 Contact
54 Contact
56 Area section
58 Area section
60 Housing

The invention claimed is:

1. A power supply module for supplying power to at least one light strip, wherein the power supply module is configured in such a way that it is electrically connectable to a connecting module, the connecting module for mechanically connecting two light strips each having at least one semiconductor light source and having at least two electrical contacts arranged in a housing, which electrical contacts each have two contact sections for making electrical contact with the light strips, wherein the electrical contacts in each case pass through the housing with a further contact section for connection to a power supply, wherein said power supply module has a connection side with at least two contacts for making contact with the contacts of the connecting module, wherein a respective contact of the power supply module has a contact area for making electrical contact with the contact of the connecting module, wherein a respective contact area has at least two area sections in order to electrically connect the power supply module, in a plurality of orientations, to the connecting module, wherein the area sections of a respective contact are arranged on a partial circle, wherein an area section of a respective contact, in a state in which the power supply module is connected to the connecting module, is arranged substantially on a transverse axis that extends transversely to the longitudinal direction, and a further area section is arranged on a longitudinal axis extending in a longitudinal direction.

2. The power supply module as claimed in claim 1, wherein said power supply module is configured in such a way that it is connectable, substantially flush, to the connecting module.

3. The power supply module as claimed in claim 1, comprising an outer side pointing away from the connection side and peripheral sides formed between the connection side and the outer side, wherein the supply line for connecting the contacts of the power supply module opens out into one of the peripheral sides.

4. A power supply module for supplying power to at least one light strip, wherein the power supply module is configured in such a way that it is electrically connectable to a connecting module, the connecting module for mechanically connecting two light strips each having at least one semiconductor light source and having at least two electrical contacts arranged in a housing, which electrical contacts each have two contact sections for making electrical contact with the light strips, wherein the electrical contacts in each case pass through the housing with a further contact section for connection to a power supply, wherein said power supply module has a connection side with at least two contacts for making contact with the contacts of the connecting module, wherein a respective contact of the power supply module has a contact area for making electrical contact with the contact of the connecting module, wherein a respective contact area has at least two area sections in order to electrically connect the power supply module, in a plurality of orientations, to the connecting module, wherein two contacts are provided, whose area sections are each arranged on a common or on different partial circles, or wherein three contacts are provided, wherein the area sections of two contacts are arranged on a common partial circle, or wherein four contacts are provided, wherein the area sections of in each case two contacts are arranged on a common partial circle.

5. A connecting module comprising:

a housing, a first and a second light strips each having at least one semiconductor light source, and an electrical contact having a first, a second and a third contact sections, wherein the first and the second contact sections are arranged in the housing, which make respective electrical contact with the first and the second light strips, and wherein the third contact section passes through the housing, for connection to a power supply, in a direction opposite to the first and the second contact section, wherein the third contact section pass through the housing from a common connection side, wherein the common connection side points approximately in the emission direction of the semiconductor light source.

6. The connecting module as claimed in claim 5, wherein two connecting sides pointing away from one another are provided on the housing for connecting the housing to in each case one light strip, and a connection side is formed between the connecting sides.

7. The connecting module as claimed in claim 5, wherein the third contact section opens out into the connection side approximately centrally, when viewed in the longitudinal direction of the connecting module.

* * * * *